US006422952B1

(12) United States Patent
Maruoka et al.

(10) Patent No.: US 6,422,952 B1
(45) Date of Patent: Jul. 23, 2002

(54) GOLF BALL

(75) Inventors: Kiyoto Maruoka, Hyogo (JP); Noritoshi Nakagawa, 360, 2-chome, Kagamiyama, Higashihiroshima-shi, Hiroshima (JP)

(73) Assignees: Noritoshi Nakagawa, Hiroshima; Sumitomo Rubber Industries, Ltd., Hyogo, both of (JP)

( * ) Notice: Subject to any disclaimer, the term of this patent is extended or adjusted under 35 U.S.C. 154(b) by 41 days.

(21) Appl. No.: 09/708,500

(22) Filed: Nov. 9, 2000

(30) Foreign Application Priority Data

Nov. 17, 1999 (JP) ..... 11-326331

(51) Int. Cl.[7] ..... A63B 37/00; A63B 37/04; A63B 37/06

(52) U.S. Cl. ..... 473/351; 473/377; 473/371

(58) Field of Search ..... 473/351, 367, 473/368, 371, 370, 373, 374, 376, 377

(56) References Cited

U.S. PATENT DOCUMENTS 4,353,557 A * 10/1982 Kajita et al. ..... 260/998.14
6,180,722 B1 * 1/2001 Dalton et al. ..... 473/373
6,284,840 B1 * 9/2001 Rajagopalan et al. ..... 473/354

FOREIGN PATENT DOCUMENTS

JP 6154357 6/1994
JP 07155403 A * 6/1995 ..... A63B/37/00
JP 8243192 9/1996

* cited by examiner

*Primary Examiner*—Paul T. Sewell
*Assistant Examiner*—Alvin A. Hunter, Jr.
(74) *Attorney, Agent, or Firm*—Birch, Stewart, Kolasch & Birch, LLP

(57) ABSTRACT

A golf ball is composed of a core (1) and a cover (3) covering the core (1). The core (1) is composed of a cross-linked rubber whose Young's modulus lies in the range of 3O Mpa to 100 Mpa both inclusive and whose loss factor lies in the range of 0.01 to 0.45 both inclusive, when the Young's modulus and the loss factor are measured by a split Hopkinson's bar tester whose impact bar has a collision speed of 14.0 m/sec.

2 Claims, 4 Drawing Sheets

GOLF BALL

BACKGROUND OF THE INVENTION

1. Field of the Invention

The present invention relates to a golf ball having a layer composed of a cross-linked rubber.

2. Description of the Related Art

A flight distance is one of the important performances of the golf ball demanded by a golfer. The golf ball that flies a long distance refreshes the golfer and contributes to gaining good scores. It is necessary to improve the repulsive performance of the golf ball to improve the flight distance thereof.

Feeling is another important performance of the golf ball demanded by the golfer. The golf ball for which the golfer has a soft feeling gives the golfer a sense of security and contributes to the stability of swinging.

That is, it is important that the golf ball has a good repulsion performance and gives the golfer a soft feeling. To achieve this, various investigations have been made to improve the physical property of the golf ball. For example, in Japanese Patent Application Laid-Open No. 6-154357, there is disclosed a two-piece golf ball in which device is made in distribution of hardness. In Japanese Patent Application Laid-Open No. 8-243192, there is disclosed a two-piece golf ball in which the flexural rigidity modulus of the cover, the surface hardness of the core, and the sectional hardness of the core are set to a predetermined range, respectively. Further, in addition to the hardness of the golf ball, investigations have been made on other values of its physical property such as its compressive strains amount, and Young's modulus and loss factor, both of which are measured by a viscoelastic spectrometer.

The repulsion performance and the golfer's feeling are manifested in the state in which the golf ball is actually hit, namely, in a dynamic state. On the other hand, the above-described hardness, flexural rigidity modulus, compressive strain amount, Young's modulus, and loss factor are so-called static physical properties of the golf ball. Thus, no matter how much the static physical properties are investigated, it is difficult to achieve the improvement of the dynamic performance sufficiently.

A repulsive viscoelasticity spectrometer can be used as a means for measuring the physical property of the golf ball in the dynamic state. The repulsive viscoelasticity spectrometer measures the physical property of a specimen by applying a dynamic strain thereto. However, the speed of the strain imparted to the material of the golf ball by the repulsive viscoelasticity spectrometer is as low as 0.001/sec to 0.1/sec, and a maximum strain is also as low as 0.01% to 2%. This is because the material of the golf ball has a high hardness and is thus not deformed greatly by a force applied thereto by the repulsive viscoelasticity spectrometer. On the other hand, when the golf ball is actually hit by a golfer, the speed of the strain of the golf ball lies in the range of 2000/sec to 5000/sec and its maximum strain is in the range as high as 5% to 25%. That is, the golf ball undergoes a high-speed and large deformation. There is a big difference between the degree of the strain of the golf ball in the case where a force is applied thereto by the repulsive viscoelasticity spectrometer and the degree of the strain thereof when it is actually hit. Therefore, the repulsive viscoelasticity spectrometer does not measure the dynamic property of the golf ball in a state similar to the state in which it is actually hit. To improve the repulsive performance of the golf ball and allow the golfer to have a soft feeling when it is hit, it is necessary to optimize the dynamic property of the golf ball in a state similar to the state in which the golf ball is actually hit.

SUMMARY OF THE INVENTION

The present invention has been made in view of the above-described situation. It is an object of the present invention to provide a golf ball having its dynamic property optimized in a state similar to the state in which the golf ball is actually hit and thus having a high repulsion performance and allowing a golfer to have a soft feeling.

To achieve the object, according to the present invention, there is provided a golf ball having a layer composed of a cross-linked rubber whose Young's modulus lies in the range of 30 Mpa to 100 Mpa both inclusive and whose loss factor lies in the range of 0.01 to 0.45 both inclusive, when the Young's modulus and the loss factor are measured by a split Hopkinson's bar tester whose impact bar has a collision speed of 14.0 m/sec.

The golf ball of the present invention has the layer composed of the cross-linked rubber. The Young's modulus of and loss factor of the layer composed of the cross-linked rubber lie within the predetermined range, respectively when they are measured by the split Hopkinson's bar tester. As will be described later, in the measurement made by the split Hopkinson's bar tester, a specimen undergoes a high-speed and a large strain. Accordingly, the viscoelastic characteristic value (Young's modulus and loss factor) of the specimen can be measured in a state similar to the state in which a golf ball is actually hit. It is possible to enhance the dynamic performance of the golf ball, namely, to improve the repulsion performance and allow a golfer to have a soft feeling by optimizing the Young's modulus and the loss factor.

The Young's modulus of :the layer composed of the cross-linked rubber lies in the range of 30 Mpa to 100 Mpa both inclusive when the split Hopkinson's bar tester measured it. Because the Young's modulus lies within the range, the golf ball of the present invention has a preferable repulsion performance and allows a golfer to have a soft feeling when it is hit. That is, if the Young's modulus is less than the lower limit of the range, the repulsion performance thereof may deteriorate, whereas if the Young's modulus is more than the upper limit of the range, the golf ball may give the golfer a hard feeling when it is hit. From this point of view, it is preferable to set the Young's modulus to lie in the range of 40 Mpa to 80 Mpa both inclusive.

The loss factor of the layer composed of. the cross-linked rubber lies in the range of 0.01 to 0.45 both inclusive when the split Hopkinson's bar tester measured it. Because the loss factor lies in this range, the golf ball has a preferable repulsion performance and allows the golfer to have a soft feeling when it is hit. That is, if the loss factor of the layer composed of the cross-linked rubber is less than the lower limit of the range, the golf ball may give the golfer a hard feeling when it is hit, whereas if the loss factor thereof is more than the upper limit of the range, the repulsion performance of the golf ball may deteriorate. From this point of view, it is preferable to set the loss factor of the layer to lie in the range of 0.1 to 0.3 both inclusive.

The golf ball of the present invention may be a one-piece golf ball consisting of the layer of the cross-linked rubber satisfying the above-described conditions or may be a two-piece golf ball consisting of the core composed of the layer of the cross-linked rubber and the cover covering the core.

The golf ball may be a multi-piece golf ball having three or more layers, one layer of which is composed of the cross-linked rubber. Above all, the two-piece golf ball is particularly favorable because it display's the effect of the layer composed of the cross-linked rubber satisfying the above-described conditions.

DETAILED DESCRIPTION OF THE PREFERRED EMBODIMENTS

The embodiments of the present invention will be described below with reference to the drawings.

Figure 1:
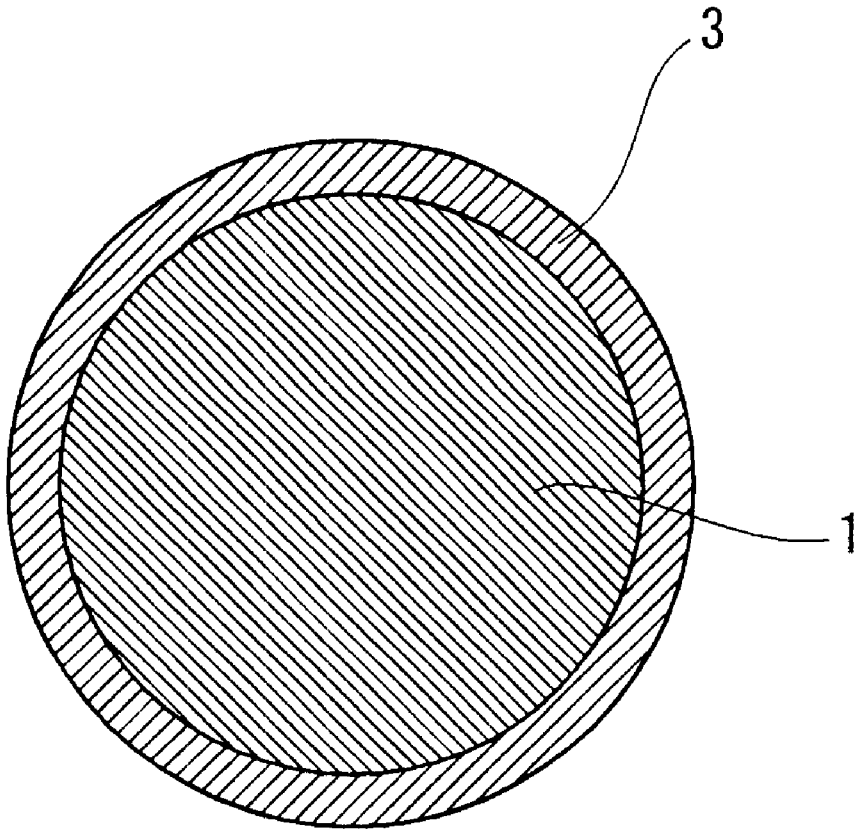
FIG. 1 is a sectional view showing a golf ball according to an embodiment of the present invention.

FIG. 1 is a sectional view showing a golf ball according to an embodiment of the present invention. The golf ball has a core 1 and a cover 3 covering the core 1. That is, the golf ball is a two-piece golf ball. The diameter of the golf ball is about 42.8mm. The diameter of the core 1 is about 38.4 mm. The thickness of the cover 3 is about 2.2 mm.

The cover 3 is formed from synthetic resin. Ionomer resin is preferably used to form the cover 3. As necessary, an appropriate amount of a colorant, a deterioration inhibitor, and the like are added to the synthetic resin composing the cover 3.

The core 1 is composed of a cross-linked rubber whose Young's modulus measured by a split Hopkinson's bar tester lies in the range of 30 MPa to 100 MPa both inclusive and whose loss factor measured thereby lies in the range of 0.01 to 0.45 both inclusive. The following rubbers can be used as the base material of the core 1: polybutadiene, natural rubber, polyisoprene, styrene-butadiene copolymer, and ethylene-propylene-diene copolymer (EPDM) Above all, cis-1,4-polybutadiene having the cis structure at 40% or more is preferable because it has an action of preventing the loss factor from becoming too large. When the cis-1,4-polybutadiene is mixed with other rubbers, the ratio of the cis-1,4-polybutadiene to the mixture of the entire rubbers is favorably 70 or more and more favorably 90 or more in mass percentage to allow the core 1 to have the loss factor in the above-described range.

Known cross-linking agents can be used for the core 1. Cross-linking of a rubber by a metallic salt of aliphatic acid or fatty ester, is preferable because the metallic salt of aliphatic acid or the fatty ester prevents the Young's modulus of the core 1 from becoming too low and its loss factor from becoming too high. A metallic salt of unsaturated carboxylic acid is a preferable cross-linking agent. More specifically, a monovalent or bivalent metallic salt of unsaturated carboxylic acid having carbon atoms in the range of three to eight can be preferably used. In particular, zinc acrylate can be preferably used because it allows the Young's modulus and the loss factor to lie in the above-described range, respectively.

In the case where the zinc acrylate is used as the cross-linking agent, to allow each of the Young's modulus and the loss factor to have the above-described range, favorably, 15 to 50 parts of the zinc acrylate and more favorably 25 to 35 parts thereof is added to 100 parts of the rubber. If the addition amount of the zinc acrylate is less than the lower limit, the loss factor of the core 1 may be large. On the other hand, if the addition amount thereof is more than the upper limit, the Young's modulus thereof may be high. The numerical values indicated by "part" mean ratios in mass.

It is preferable to use an organic peroxide in combination with the cross-linking agent in cross-linking the rubber of the core 1. Dicumyl peroxide and 1,1-bis (t-butylperoxide-3,3,5-trimethyl-cyclohexane) can be preferably used as preferable organic peroxides. To allow the core 1 to have both the Young's modulus and the loss factor in the above-described range, respectively, favorably 0.1 to 2.0 parts of the organic peroxide and more favorably 0.3 to 0.5 parts thereof is added to 100 parts of the rubber. If the addition amount of the organic peroxide is less than the lower limit, the loss factor of the core 1 may be large. On the other hand, if the addition amount thereof is more than the upper limit, the Young's modulus thereof may be high.

Zinc oxide may be added to the rubber of the core 1 as a cross-linking assistant to prevent the Young's modulus from becoming too low. Favorably 5 to 30 parts of the zinc oxide and more favorably 7 to 20 parts thereof is added to 100 parts of the rubber. If the addition amount of the zinc oxide is less than the lower limit, the Young's modulus of the core 1 may be low. On the other hand, if the addition amount thereof is more than the upper limit, the specific gravity of the core 1 may be large and the golf ball may be heavy. In this case, the golf ball may not conform to the standard.

Triazinethiol compound may be added to the rubber composing the core 1. The resin composing the core 1 is subjected to a high temperature of 140° C. to 220° C. in a cross-linking. But the addition of the triazinethiol compound to the rubber increases the heat-resistant performance of the core 1, thus suppressing the heat deterioration thereof in the cross-linking. Accordingly, the loss factor of the core 1 is reduced. The triazinethiol compound contains at its end group a compound of —SH, a compound of $—N(C_4H_9)_2$, and a compound of $—NHC_6H_5$. According to the present invention, any of these compounds can be used. It is preferable to use these compounds, depending on a cross-linking temperature and the like. Favorably 0.2–2 parts of the triazinethiol compound and more favorably 0.5 to 1 parts thereof is added to 100 parts of the rubber. If the addition amount of the triazinethiol compound is less than the lower limit, the loss factor of the core 1 may be large. If the addition amount thereof is more than the e upper limit, there is no increase in the effect of the triazinethiol compound of suppressing the heat deterioration. Thus, the addition of an excess amount thereof is uneconomical.

Thiophenols may be added to the rubber of the core 1 as a peptizing agent. The addition of the thiophenols prevents the loss factor from becoming too large. Favorably 0.1–2.0 parts of the thiophenols and more favorably 0.3 to 1.0 part thereof is added to 100 parts of the rubber. If the addition amount of the thiophenols is less than the lower limit, the loss factor of the core 1 may be large. on the other hand, if the addition amount thereof is more than the upper limit, the core 1 may be soft and thus the loss factor thereof may be extremely large.

It is possible to add an appropriate amount of a colorant, a deterioration inhibitor, a oxidation inhibitor, extending agent, and the like as necessary to the rubber composition composing the core 1 in the range in which the Young's modulus thereof is maintained in the range of 30 Mpa to 100 Mpa both inclusive and the loss factor thereof is maintained in the range of 0.01 to 0.45 both inclusive.

The core 1 is formed by heating/cross-linking the kneaded and preformed rubber composition in a die. The rubber composition of the core 1 is cross-linked favorably in the range of 140° C. to 220° C. and more favorably in the range of 150° C. to 170° C. If the cross-linking temperature is lower than the lower limit, insufficient cross-linking occurs, which may lead to an increase of the loss factor of the core 1. On the other hand, if the cross-linking temperature is higher than the upper limit, excess cross-linking occurs, which may cause the Young's modulus to be high.

Figure 2:
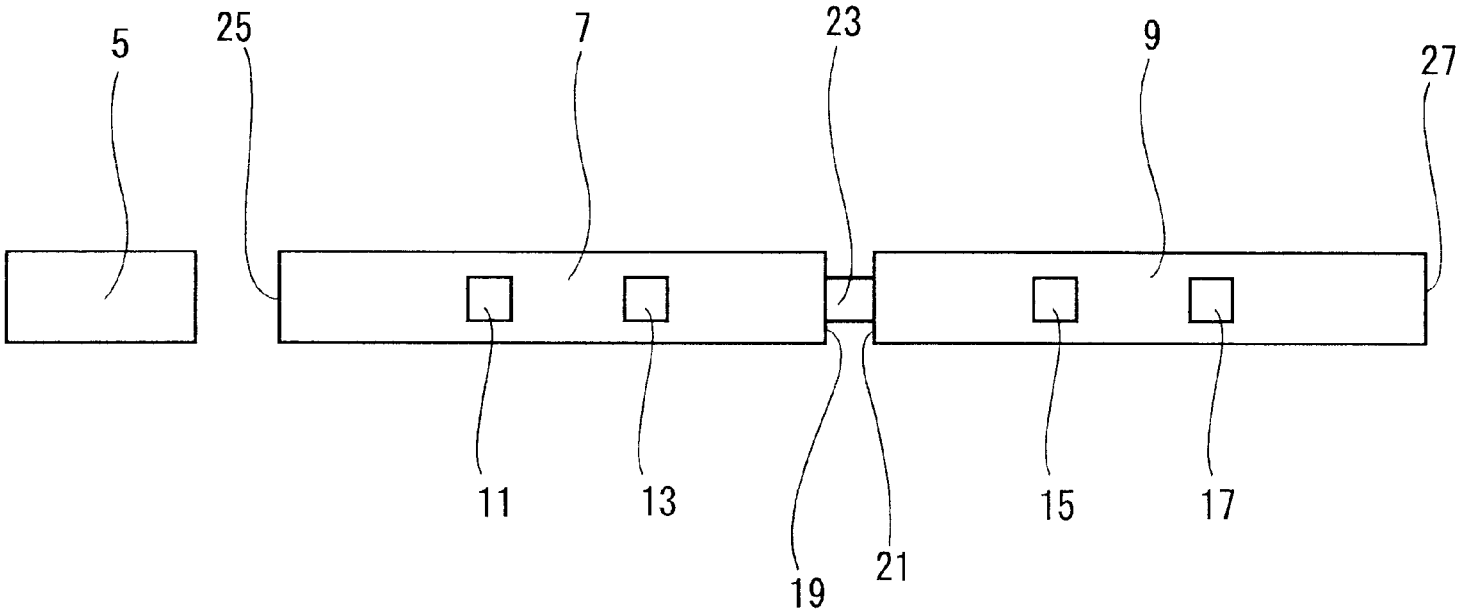
FIG. 2 is a front view showing a split Hopkinson's bar tester for measuring the Young's modulus of the golf ball and the loss factor thereof shown in FIG. 1.

FIG. 2 is a front view showing the split Hopkinson's bar for measuring the Young's modulus and loss factor of the core 1 of the golf ball shown in FIG. 1. The split Hopkinson's bar has a impact bar 5, an input bar 7, and an output bar 9 arranged in a straight line. A first strain gauge 11 and a second strain gauge 13 are installed on the input bar 7. A third strain gauge 15 and a fourth strain gauge 17 are installed on the output bar 9. A disc-shaped specimen 23 is put between a rear end 19 of the input bar 7 and a front end 21 of the output bar 9. The specimen 23 may be formed by molding a rubber composition of the core 1 into the shape of the specimen or may be cut off from the core 1 molded spherically. The split Hopkinson's bar tester is left in an environment having a room temperature of 23° C. and a relative humidity of 50%.

Each of the impact bar 5, the input bar 7, and the output bar 9 is a cylinder made of polymethyl methacrylate. The sectional diameter, Young's modulus, and specific gravity thereof are 20 mm, 5300 Mpa, and 1.19, respectively. The length of the impact bar 5 is 100 mm. The length of each of the input bar 7 and the output bar 9 (the input bar 7 and the output bar 9 may be hereinafter referred to as "stress bar") is 2000 mm. The first strain gauge 11 is installed on the input bar 7 at a position 900 mm spaced from the rear end 19 thereof. The second strain gauge 13 is installed on the input bar 7. at a position 600 mm spaced from the rear end 19 thereof. The third strain gauge 15 is installed on the output bar 9 at a position 300 mm spaced from the front end 21 thereof. The fourth strain gauge 17 is installed on the output bar 9 at a position 600 mm spaced from the front end 21 thereof. The length (namely, distance between the rear end: 19 of the input bar 7 and the front end 21 of the output bar 9) of the specimen 23 is 4 mm. The sectional diameter of the specimen 23 is 18 mm.

The split Hopkinson's bar tester is used to examine physical properties of a metal. material and is primarily inappropriate for evaluating a synthetic resinous material such as the core of the golf ball. In the split Hopkinson's bar tester shown in FIG. 2, the impact bar 5, the input bar 7, and the output bar 9 are made of synthetic resin. The length of the output bar 9 and that of the input bar 7 are as large as 2000 mm. A long distance is provided between the first strain gauge 11 and the rear end 19 of the input bar 7 and between the. second strain gauge 13 and the rear end 19 of the input bar 7. Thus, the split Hopkinson's bar tester is also suitable for measuring the viscoelastic characteristic value of the cross-linked rubber composing the core of the golf ball.

In measuring the Young's modulus and the loss factor of the specimen 23 with the split Hopkinson's bar tester, initially, the impact bar 5 comes into collision with the front end 25 of the input bar 7 at a speed of 14 m/sec. As a result, an incident strain wave is generated. The incident strain wave proceeds toward the rear end 19 of the input bar 7. A part of the incident strain wave is reflected by the rear end 19 of the input bar 7 and proceeds to the front end 25 of the input bar 7 as a reflected strain wave. A part of the incident strain wave transmits through the specimen 23 and propagates from the rear end 19 of the input bar 7 to the output bar. 9 as a transmitted strain wave and proceeds to the rear end 27 of the output bar 9.

The incident strain wave is measured by the first strain gauge 11 and the second strain gauge 13. The frequency of a strain wave generated by the striking of the impact bar 5 against the front end 25 of the input bar 7 lies in the range of 2.5 kHz to 5.0 kHz. The waveform which is measured by each strain gauge is a synthesized wave including a noise of a high-frequency wave higher than 10 kHz. The synthesized wave is passed through a low-pass filter of 10 kHz to remove the noise. Further, a zero compensation is performed to make a base line value of the history of the incident strain wave zero. Values measured by the strain gauges should be zero until before the strain wave reaches them. But actually, a slight amount of noise is inputted to the strain gauges. Thus, the values measured by the strain gauges deviate from zero. The zero compensation is performed to prevent the measuring accuracy from deteriorating: due to the deviation. Fourier transformation of each of time-axis strains obtained at the first strain gauge 11 and the second strain gauge 13 is performed to compute a frequency-axis strain. A transmission function is derived from the frequency-axis strain at each of the first strain gauge 11 and the second strain gauge 13. A frequency-axis strain at the rear end 19 of the input bar 7 is estimated, considering the ratio of the distance X1 between the first strain gauge 11 and the rear end 19 of the input bar 7 to the distance X2 between the second strain gauge 13 and the rear end 19 of the input bar 7 and based on the transmission function. A time-axis strain (history of strain) $\epsilon i$ of the incident strain wave at the rear end 19 of the input bar 7 is obtained by performing an inverse Fourier transformation of the frequency-axis strain.

Similarly, a time-axis strain (history of strain) $\epsilon r$ of the reflected strain wave at the rear end 19 of the input bar 7 is obtained from the reflected strain wave measured by the first strain gauge 11 and the second strain gauge 13. Similarly, a time-axis strain (history of strain) $\epsilon t$ of the transmitted strain wave at the front end 21 of the output bar 9 is obtained from the transmitted strain wave measured by the third strain gauge 15 and the fourth strain gauge 17.

By using an equation (1) shown below, a strain speed $\epsilon'$ of the specimen 23 is computed from the time-axis strains $\epsilon i$, $\epsilon r$, and $\epsilon t$ thus obtained.

$$\epsilon' = (C0/L)\cdot(\epsilon i - \epsilon r - \epsilon t) = ((E/\rho)^{1/2}/L)\cdot(\epsilon i - \epsilon r - \epsilon t) \quad (1)$$

where C0 is propagation speed (m/s) of wave in stress bar, L is length (m) of specimen, E is Young's modulus ($N/m^2$) of stress bar, and $\rho$ is density of stress bar ($kg/m^3$)

By using an equation (2) shown below, a strain $\epsilon$of the specimen 23 is computed from the time-axis strains $\epsilon i$, $\epsilon r$, and $\epsilon t$.

$$\begin{aligned} \varepsilon &= (C0/L)\cdot\int_0^t (\varepsilon i - \varepsilon r - \varepsilon t)\,dt \\ &= \left\{(E/P)^{\frac{1}{2}} \Big/ L\right\}\cdot\int_0^t (\varepsilon i - \varepsilon r - \varepsilon t)\,dt \end{aligned} \quad (2)$$

where C0 is propagation speed (m/s) of wave in stress bar, L is length (m) of specimen, E is Young's modulus ($N/m^2$) of stress bar, and $\rho$ is density of stress bar ($kg/m^3$)

By using an equation (3) shown below, a stress $\sigma$ of the specimen 23 is computed from the time-axis strains $\epsilon i$, $\epsilon r$, and $\epsilon t$.

$$\sigma=(E\cdot A/(2As))\cdot(\epsilon i+\epsilon r+\epsilon t)=(E\cdot D^2/(2(Ds)^2))\cdot(\epsilon i+\epsilon r+\epsilon t) \quad (3)$$

where E is Young's modulus ($N/m^2$) of stress bar, A is sectional area ($m^2$) of stress bar, As is sectional area ($m^2$) of specimen, D is diameter (m) of stress bar, and Ds is diameter (m) of specimen.

Figure 3:
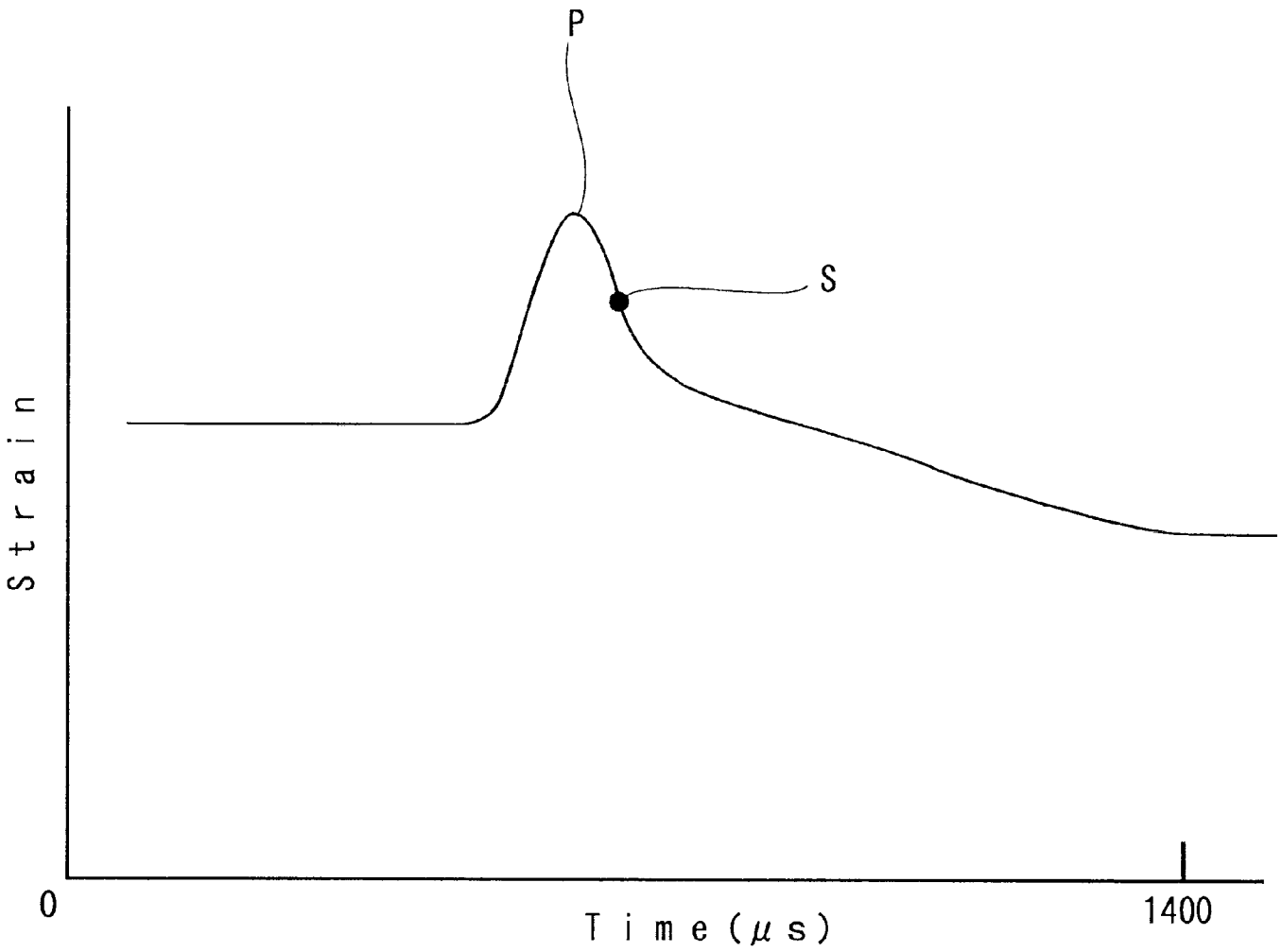
FIG. 3 is a graph showing a state before a compensation of the history of a strain of a specimen is made.

FIG. 3 is a graph showing the obtained history of the strain of the specimen 23. The curve of FIG. 3 is smooth for some time after a peak P and becomes irregular thereafter. A point S is selected from the smooth portion located after the peak P. A tangent to the curve at the point S is drawn. A relaxation time $\lambda$ is derived from the intersection point of the tangent and the time axis. It is possible to obtain the entire history of the strain as a smooth curve by replacing a curve determined by using an equation (4) shown below with the curve located subsequently to the point S. Thereby, it is possible to remove the influence of the noise on a viscoelastic characteristic value finally obtained.

$$\epsilon(t)=\epsilon_o\cdot e^{-t/\lambda} \quad (4)$$

where $\epsilon_o$ is strain at point of contact.

The point P can be selected anywhere in the smooth portion but normally, it is selected at 100 $\mu$s after the peak P.

Similarly, by using an equation (5) shown below, it is possible to obtain a smooth curve of the entire stress history. Thereby, it is possible to remove the influence of the noise on a viscoelastic characteristic value finally obtained.

$$\sigma(t)=\sigma_o\cdot e^{-t/\lambda} \quad (5)$$

where $\sigma_o$ is stress at point of contact.

Figure 4:
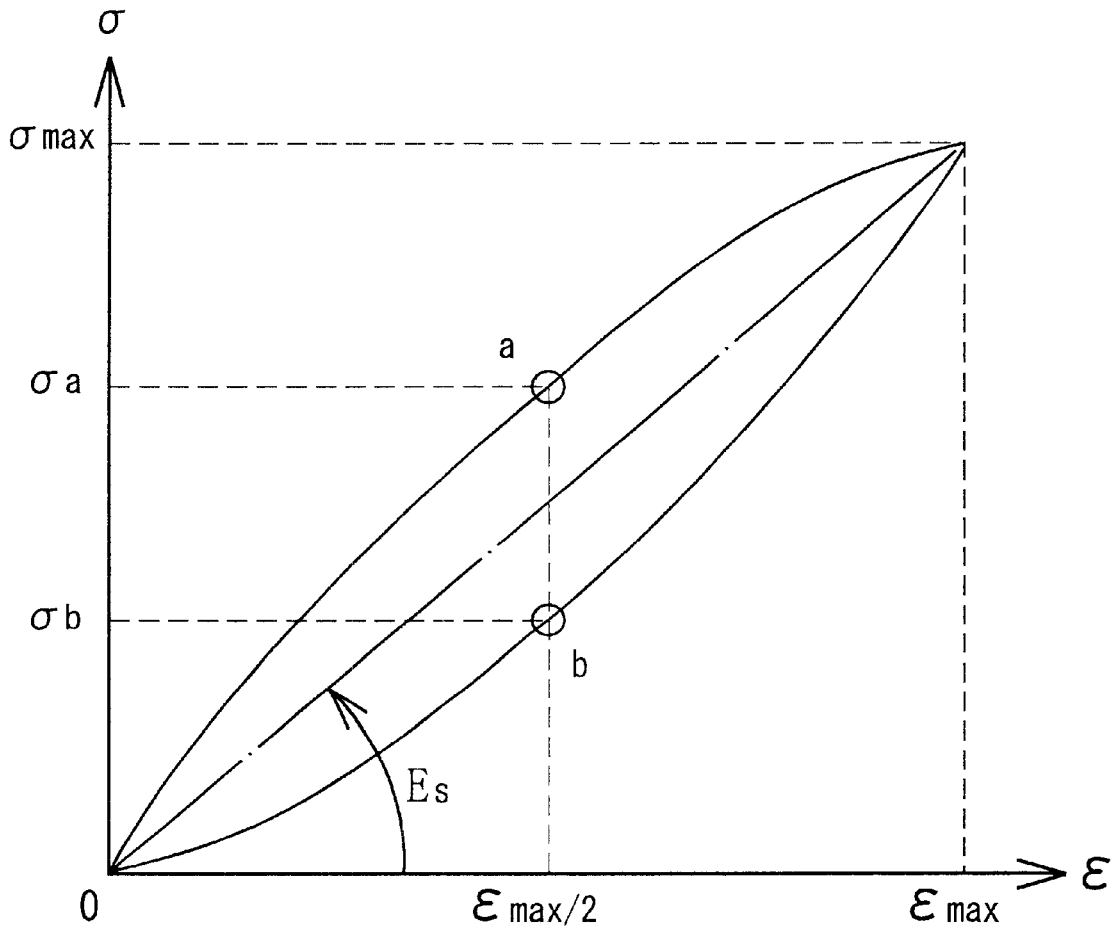
FIG. 4 is a graph showing a typical stress-strain curve.

A stress-strain curve is determined from the history of the strain and stress the specimen 23 obtained by performing the compensation. FIG. 4 is a graph showing a typical stress-strain curve. By using an equation (6) shown below, the Young's modulus of the specimen 23 is computed from the stress-strain curve.

$$Es=\sigma\max/\epsilon\max \quad (6)$$

By using an equation (7) shown below, a phase angle $\delta$ is computed from the stress-strain curve shown in FIG. 4:

$$\delta=\sin^{-1}((\sigma a-\sigma b)/\sigma\max) \quad (7)$$

The loss factor (tan $\delta$) is computed from the phase angle $\delta$.

When the impact bar 5 collides with the front end 25 of the input bar 7 at a speed of 14 m/sec, the strain speed of the specimen lies in the range of 2000 to 2500 per second, and the strain amount thereof is in the range of 15% to 25%. The deformation behavior of the strain is similar to that obtained when the golf ball is hit. That is, the Young's modulus and loss factor of the specimen measured by the split Hopkinson's bar tester indicate dynamic properties of the golf ball obtained in a state similar to the state in which. the golf ball is actually hit.

EXAMPLES

First Example

The following components were supplied to an enclosed kneader and kneaded to obtain a rubber composition: 50 parts of polybutadiene ("BR11" (trade name) manufactured by Nippon Goseigomu Inc.); 50 parts of polybutadiene ("BR200" (trade name) manufactured by Ube Kosan Inc.); 31 parts of zinc acrylate ("Sunseller SR" (trade name) manufactured by Sanshin Kagaku Inc.); 20 parts of zinc oxide; 0.4 parts of dicumyl peroxide ("Parkmill D" (trade name) manufactured by Ouchi Shinkokagaku Inc.); and 1.0 part of triazinethiol compound ("Jisnet F" (trade name) manufactured by Sankyo Kasei Inc.). The rubber composition was extruded by an extruder to prepare a columnar preform. The preform was intbaruced into a spherical die and compressed/heated at 160° C. for 30 minutes to prepare a core, having a diameter of 38.4 mm, composed of a cross-linked rubber.

Then, a resinous composition consisting of the following components was extruded by an extruder and pulverized into a pellet to obtain a rubber composition: 50 parts of ionomer resin ("Highmilan 1605" (trade name) manufactured by Mitsui Dupont Polychemical Inc.); 50 parts of another ionomer resin ("Highmilan 1706" (trade name) manufactured by Mitsui Dupont Polychemical Inc.); and two parts of titanium oxide. The core was covered with the resinous composition by using an injection molder. After pretreatment is performed, paint was applied to the cover to obtain the golf ball of the. first example. A specimen having a diameter of 18 mm and a thickness of 4 mm was cut off from the core of the golf ball. The Young's modulus and the loss factor of the specimen were measured by the split Hopkinson's bar tester shown in FIG. 2. The Young's modulus and loss factor thereof were 90.7 Mpa and 0.2154, respectively.

Second, Third, Fourth, Sixth Examples and First and Third Comparison Examples Each of the golf ball of the second, third, fourth, sixth examples and first and third comparison examples was prepared in a manner similar to that of the first example except that the amount of the dicumyl peroxide and the triazinethiol compound both added to the rubber composition of each core were altered as shown in table 1. Table 1 shows the Young's moduli and loss factors of the cores of the respective golf balls.

Fifth Example

The golf ball of the fifth example was prepared in a manner similar to that of the first example except that 0.5 parts of diphenyl disulfide (manufactured by Sumitomo Seika Inc.) was added to the rubber composition of the core. Table 1 shows the Young's modulus and loss factor of the core of the golf ball.

Second Comparison Example

The golf ball of the second comparison example was prepared in a manner similar to that of the first example except that 0.5 parts of an antioxidant (manufactured by Ouchi Shinko Kagaku Inc.) was added to the rubber composition of the core and that the triazinethiol compound was not added thereto; Table 1 shows the Young's modulus and loss factor of the core of the golf ball. (Measurement of Coefficient of Repulsion)

In the condition of a room temperature 23° C., a hollow bar made of aluminum collided with each golf ball at a speed of 45 m/sec to measure the coefficient of repulsion thereof. Table 1 shows the result. The golf ball having a larger coefficient of repulsion is higher in its repulsion performance and thus flies a longer distance.

Measurement of Impulsive Force

A driver ("Dunlop DP10" (trade name) manufactured by SUMITOMO RUBBER INDUSTRIES,LTD.) was installed on a swing machine manufactured by True Temper Inc. Each golf ball was hit with the driver at a head speed of 45 m/sec. To measure the acceleration: of each golf ball, an acceleration pick-up meter was installed on the side sole of the head of the driver such that the acceleration pick-up meter was coaxial with the flight direction of the golf ball. The acceleration was multiplied by the weight (210 g) of the head to compute the impulsive force of each golf ball. Table 1 shows the result. The golf ball having a lower impulsive force imparts a lower degree of impact to the golfer.

Feeling Test 100 golfers hit each golf ball so that they evaluate feeling they had for each golf ball. The golf balls were evaluated in four grades. That is, excellent golf balls that gave them a soft feeling were denoted as "three marks". Good golf balls that gave them a soft feeling in a lower degree were denoted as "two marks". Golf balls that gave them a feeling not soft nor hard were denoted as "one mark". Golf balls that gave them a hard feeling were denoted as "zero mark". The average of the marks evaluated by the 100 golfers was computed for each golf ball. Table 1 shows the result.

TABLE 1

| | First CE | Second E | Third E | Fourth E | First E | Fifth E | Second CE | Sixth E | Third CE |
|---|---|---|---|---|---|---|---|---|---|
| BR11 | 50 | 50 | 50 | 50 | 50 | 50 | 50 | 50 | 50 |
| BR200 | 50 | 50 | 50 | 50 | 50 | 50 | 50 | 50 | 50 |
| Zinc acrylate | 31 | 31 | 31 | 31 | 31 | 31 | 31 | 31 | 31 |
| Zinc oxide | 20 | 20 | 20 | 20 | 20 | 20 | 20 | 20 | 20 |
| Dicumyl peroxide | 0.07 | 0.1 | 0.2 | 0.3 | 0.4 | 0.4 | 0.4 | 0.5 | 0.6 |
| Triazinethiol compound | — | 1.0 | 1.0 | 1.0 | 1.0 | 1.0 | — | 1.0 | — |
| Diphenyl disulfide | — | — | — | — | — | 0.5 | — | — | — |
| Antioxidant | — | — | — | — | — | — | 0.5 | — | — |
| Young's modulus (MPa) | 24.3 | 31.1 | 44.1 | 73.7 | 90.7 | 44.1 | 45.3 | 98.8 | 113.0 |
| Loss factor | 0.5274 | 0.4375 | 0.3573 | 0.2351 | 0.2154 | 0.2871 | 0.5042 | 0.1920 | 0.1880 |
| Repulsion coefficient | 0.737 | 0.757 | 0.763 | 0.777 | 0.781 | 0.774 | 0.739 | 0.784 | 0.786 |
| Impulsive force (N) | 11180 | 11317 | 12082 | 12798 | 13121 | 12150 | 12249 | 13445 | 14073 |
| Feeling | 2.7 | 2.7 | 2.4 | 2.0 | 1.9 | 2.3 | 2.1 | 1.8 | 0.8 |

Where E is example, and CE is comparison example.

Referring to table 1, the golf ball of the first comparison example having the very low Young's modulus and the very large loss factor had the small coefficient of repulsion. The golf ball of the second comparison example having the very large loss factor had the small coefficient of repulsion. The golf ball of the third comparison example having the very high Young's modulus had the large impulsive force and the bad mark for feeling. On the other hand, the Young's modulus and loss factor of each of the golf balls of the first through sixth examples lied within the predetermined range. Therefore, each of the golf balls of the first through sixth examples had the large coefficient of repulsion, the preferable impulsive force, and the good mark for feeling. That is, the golf ball of the present invention is superior to the conventional golf ball.

The present invention has been described on the two-piece golf ball but is preferably applicable to one-piece golf ball and a multi-piece golf ball.

As apparent from the foregoing description, the dynamic property of the golf ball of the present invention is optimized in a state similar to the state in which the golf ball is actually hit. Accordingly, the golf ball of the present invention allows the golfer to hit it a long flight distance and have a favorable feeling.

What is claimed is:

1. A golf ball having a layer composed of a cross-linked rubber whose Young's modulus lies in the range of 30 Mpa to 100 Mpa both inclusive and whose loss factor lies in the range of 0.01 to 0.45 both inclusive, when said Young's modulus and said loss factor are measured by a split Hopkinson's bar tester whose impact bar has a collision speed of 14.0 m/sec.

2. A golf ball having a core composed of a cross-linked rubber whose Young's modulus lies in the range of 30 Mpa to 100 Mpa both inclusive and whose loss factor lies in the range of 0.01 to 0.45 both inclusive, when said Young's modulus and said loss factor are measured by a split Hopkinson's bar tester whose impact bar has a collision speed of 14.0 m/sec; and a cover covering said core.

* * * * *